US010800639B2

(12) United States Patent
Novacek et al.

(10) Patent No.: US 10,800,639 B2
(45) Date of Patent: Oct. 13, 2020

(54) ESCALATOR HAVING STEP TREADS THAT INTERENGAGE IN THE RETURN RUN

(71) Applicant: INVENTIO AG, Hergiswil (CH)

(72) Inventors: Thomas Novacek, Schwechat (AT); Kurt Streibig, Rekawinkel (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 16/346,271

(22) PCT Filed: Oct. 20, 2017

(86) PCT No.: PCT/EP2017/076803
§ 371 (c)(1),
(2) Date: Apr. 30, 2019

(87) PCT Pub. No.: WO2018/077730
PCT Pub. Date: May 3, 2018

(65) Prior Publication Data

US 2019/0263633 A1 Aug. 29, 2019

(30) Foreign Application Priority Data

Oct. 31, 2016 (EP) ..... 16196543

(51) Int. Cl.
*B66B 23/12* (2006.01)
*B66B 23/14* (2006.01)

(52) U.S. Cl.
CPC ..... *B66B 23/12* (2013.01); *B66B 23/14* (2013.01)

(58) Field of Classification Search
CPC ..... B66B 23/14
See application file for complete search history.

(56) References Cited

U.S. PATENT DOCUMENTS 7,381,006 B2 6/2008 Streibig
8,739,957 B2 * 6/2014 Teramoto ..... B66B 23/026 198/334

(Continued)

FOREIGN PATENT DOCUMENTS

CN 101948074 A 1/2011
CN 104955761 A 9/2015

(Continued)

OTHER PUBLICATIONS

International Search Report for International Application No. PCT/EP2017/076803 dated Feb. 13, 2018.

*Primary Examiner* — Timothy R Waggoner
*Assistant Examiner* — Lester Ill Rushin
(74) *Attorney, Agent, or Firm* — Knobbe Martens Olson & Bear LLP

(57) ABSTRACT

An escalator is described that is designed in an installation space-saving manner and can be operated with low wear. The escalator has a plurality of treads and a guide-rail assembly to guide the treads during a return run. Each tread front intermeshing structure and a rear intermeshing structure that are complementarily configured in such a manner that they can meshably engage into one another in the forward run. The escalator is configured such that at least in a central region of the return run moving at an incline, the intermeshing structures of adjacent treads are meshably arranged with each other. As a result, the dimensions of the escalator can be reduced and adjacent treads can mutually guide each other through the meshing engagement.

20 Claims, 4 Drawing Sheets

(56) References Cited

U.S. PATENT DOCUMENTS

| | | | | |
|---|---|---|---|---|
| 2008/0149457 | A1 | 2/2008 | Matheisl | |
| 2016/0355379 | A1 * | 12/2016 | Matheisl | B66B 21/02 |

FOREIGN PATENT DOCUMENTS

| | | | | |
|---|---|---|---|---|
| DE | 10085003 | T1 | 10/2002 | |
| EP | 1502892 | A1 | 2/2005 | |
| EP | 3292068 | B1 * | 5/2019 | B66B 23/028 |
| JP | 3790788 | B2 | 6/2006 | |
| JP | 5814454 | B1 | 5/2016 | |
| JP | 2016094287 | | 5/2016 | |

* cited by examiner

ESCALATOR HAVING STEP TREADS THAT INTERENGAGE IN THE RETURN RUN

TECHNICAL FIELD

The present disclosure relates to an escalator.

SUMMARY

Escalators, sometimes described as moving staircases, are used transport people between two levels along a travel path. To do this, the escalator provides a plurality of treads that are arranged one after another along the travel path. Each of the treads provides a tread surface that is oriented upward during the forward run of the escalator and can be stepped on by the people to be delivered. At a rear end of this tread surface toward the top when viewed in a conveying direction, a riser running transverse to this tread surface abuts it. The treads are connected together via a traction means, for example, a step chain or a belt, and form a step band. A drive unit can drive the step band or the step chain and thus displace the treads along the travel path in a forward run. The forward run of the travel path in an escalator conveying from the bottom to the top thus extends from a lower horizontally running region adjacent to an entrance to the escalator over a central region that runs at an incline through to an upper horizontally running region adjacent to an exit of the escalator. Because the step band or the step chain is formed circumferentially, the treads during a return run are moved in an opposite direction and essentially parallel to the travel path of the forward run.

Each of the treads typically has a front intermeshing structure with adjacent ribs and interposed grooves at a forward directed end face that runs transverse to the tread. In addition, each tread typically has a rear intermeshing structure also with adjacent ribs and interposed grooves at a rearward directed region of the riser. The front and the rear intermeshing structures are thus adapted to each other and preferably designed complementary to each other so that they can meshably (meshingly) engage into each other in the forward run of the escalator. Expressed differently, if the escalator is moved along the forward run of the travel path, the front intermeshing structure of one of the treads engages into the rear intermeshing structure of the adjacent tread in such a manner that the ribs of the front intermeshing structure engage into the grooves of the rear intermeshing structure and the ribs of the rear intermeshing structure engage into the grooves of the front intermeshing structure. On the one hand, by this, the gap that is inevitably provided between adjacent treads is formed in a meandering manner such that the risk of an object, such as a passenger's shoe, can be entangled in it is minimized. On the other hand, a meshably engaged adjacent tread can also support a guiding of the tread, meaning adjacent treads can hardly move in a direction transverse to the travel path relative to one another.

Previous escalators were optimally designed so as to produce optimal safety and a high level of traveling comfort for passengers. In particular, the type of intermeshing structure as well as the manner in which the treads are guided along the travel path in the forward run were adapted in this regard so that the intermeshing structures can engage into one another as safely as possible and with the smallest gap between adjacent intermeshing structures.

However, those skilled in the art have previously assumed that when there is normal deflection of the treads because of the reversed direction of motion during the return run relative to the forward run and the resulting different relative motion between adjacent treads during the return run relative to the forward run, it is not possible or, at least, it is associated with risks considered to be unacceptable, to allow treads of an escalator to meshably engage into each other during return the return run, as well.

Based on this preconception, escalators were previously constructed in such a manner that their treads always remained sufficiently spaced apart during the return run. To do this, however, the escalators had to be designed with relatively large dimension, whereby the installation space necessary for an escalator was increased.

In addition, the treads had to be guided laterally during the return run using appropriate measures to prevent their deviation from the travel path in a direction transverse to the travel path, whereby additional design measures were nevertheless required, and in many cases, an increased wear on components of the escalator ensued.

An escalator having meshing treads in the return run is, indeed, disclosed in JP 3 790788 B2. This, however, requires a specialized and very expensive deflection mechanism so that the tread surfaces of the treads are directed upward in the return run as in the forward run.

There can, therefore, be a need for an escalator, in which the previously mentioned disadvantages, in particular, are prevented or at least reduced. In particular, there can be a need for an escalator having a small installation space and/or low wear and tear.

Such a need can be addressed by the escalator described herein. Advantageous embodiments are described throughout the following description.

According to one aspect of the disclosure, an escalator is proposed that has a plurality of treads oriented one after another along a travel path, wherein each tread has a tread surface and a riser adjacent to a rear end of the tread surface and running transverse to the tread surface. In addition, the escalator has a guide-rail assembly that comprises a chain roller guide rail to guide chain rollers of the treads and an idler roller-guide rail to guide idler rollers of the treads. These guide rails extend over a forward run from a lower horizontally running region of the travel path through a central region running at an incline toward an upper horizontally running region of the travel path and along a return run moving in the opposite direction. Each tread has a front intermeshing structure and a rear intermeshing structure, wherein the front and the rear intermeshing structures are formed complementary to each other in a manner such that intermeshing structures of neighboring treads oriented toward one another can meshably engage into each other, Between the upper horizontally running region and the central region running at an incline there is a transition region. In the transition region of the return run, the chain roller guide rail and/or the idler roller guide rail have two curved regions close to the border of the upper and the central regions having a sharp curvature and an interposed curved region having a gentler curvature. This special design of the guide-rail assembly allows that, at least in the central region of the return run running at an incline, the intermeshing structures of adjacent treads are meshably arranged with each other.

Possible features and advantages of embodiments of the present disclosure may be considered, among others and without limiting the disclosure, to be related to the concepts described below.

It was recognized that, despite the long-cherished prejudice referred to at the beginning, adjacent treads of an escalator can advantageously and, in particular, without excessive risk, be permitted to meshably engage into each other even during their return run. It was found that the treads should be guided in a different manner during the return run than was the case in previous escalators. In other words, it was determined that, in this manner, the guide-rail assembly that guides the treads can be appropriately modified and specifically designed, in particular, at that point where it guides the treads along the return run, so that adjacent treads are guided closer to each other and that it comes to a safe engagement by its opposing intermeshing structures and thus to a meshing arrangement.

Based on the realization that the treads can be guided intermeshably engaged into each other even during the return run by an appropriately adapted guide-rail assembly, a reduction of the installation space necessary for the escalator can be made possible, on the one hand. During the return run, the treads are moved to lie closer together so that the space requirement for the return travel of the escalator is significantly reduced.

On the other hand, the option to guide the treads meshably engaged into each other also during the return run allows a better lateral guidance of the treads during the return run, meaning a greater control of their range of motion in a direction transverse to the longitudinal direction of the escalator. For example, this can prevent additional design measures for lateral guidance of the treads or at least minimize them and/or reduce wear and tear on components of the treads.

According to one embodiment, the guide-rail assembly has a chain roller guide rail for guiding chain rollers of the treads and an idler roller guide rail for guiding idler rollers of the treads.

In other words, different rollers in the form of chain rollers and idler rollers are typically mounted on the treads in order to be able to move the treads in a guided manner along the travel path. It was recognized as advantageous to guide these different rollers using different guide rails. The chain rollers are guided along the chain roller guide rail and the idler rollers are guided along the idler roller guide rail. Because the two types of guide rails can be designed differently and, in particular, the corresponding rollers can be guided along different paths, which do not necessarily have to be parallel, it can be achieved that a tread held by the guided chain and idler rollers can be tilted or swiveled in a desired direction during the process. Such a tilting or swiveling of the treads can be advantageously used during the passage through the return run to move the treads closer to each other in a manner in which their teeth can be inserted meshably engaged into each other simply and without significant risk of collision or canting.

It should be noted that the guide rail assembly should have at least one chain-roller guide rail and at least one idler roller guide rail. Usually, however, chain-rollers and idler rollers are attached to the two opposite sides of the treads, so that, generally, two chain-roller guide rails and two traction-roller guide rails are provided in the guide rail assembly. These are each arranged along opposing sides of the travel path and at a distance that corresponds to approximately the width of the treads running between them. The term chain roller is to be broadly interpreted here, meaning that this need not necessarily be part of a chain. The term, rather, indicates those rollers by which the traction means that connects the treads is guided.

According to one embodiment, each tread close to its front end can have a chain roller orthogonally spaced apart from the tread surface at a first distance and close to its rear end can have a idler roller orthogonally spaced apart from the tread surface at a second distance that is larger than the first distance. The chain-roller guide rail and the traction-roller guide rail in the upper horizontally running region of the track are spaced farther apart from each other than in the middle region of the track running at an incline. Additionally, the chain-roller guide rail and the traction-roller guide rail in a transition region between the upper horizontally running region and the central region of the travel path running at an incline are designed to run at a different curvature relative to each other in such a manner that adjacent treads guided along the guide rail assembly are guided in such a manner that the front intermeshing structure of a tread is spaced apart from the rear intermeshing structure of the adjacent tread with a gap as long as both treads are moved along the upper horizontally running region of the track and the front intermeshing structure of the tread is meshably engaged into the rear intermeshing structure of the adjacent tread in a region of the riser, the gap between these is gradually reduced in a horizontal direction, if the two treads are moved one after another along the transition region in the central region of the track running at an incline.

In other words, preferably at least one and preferably at least two chain rollers as well as at least one, preferably at least two idler rollers are attached to each tread. The chain rollers are thus attached close to the front end of the tread and the idler rollers close to the rear end. A distance of rollers from the tread surface is thus smaller for the chain rollers than for the idler rollers. Among other things, this causes the tread during the forward run to be movable with its chain and idler rollers along a single guide rail or alternatively along two chain-roller and traction-roller guide rails parallel to each other in such a manner that their tread surfaces run essentially horizontal.

In the return run of the escalator, the chain rollers are now guided along the chain-roller guide rail provided there, while the idler rollers are guided along the traction-roller guide rail separate from it. The chain-roller guide rail and the traction-roller guide rail are thus separated from each other in the vertical direction. A distance between these different guide rails is, however, not constant along the same travel path of the return run. Instead, the distance between the chain-roller guide rail and the traction-roller guide rail in the upper horizontally running region of the track are spaced farther apart from each other than in the middle region of the track running at an incline. By virtue of the narrowly spaced chain- and traction-roller guide rails, the treads can be arranged more closely together in the middle region running at an incline, in particular, closer in such a manner that their opposing intermeshing structures can meshably engage into each other. By virtue of the narrow spacing of the chain- and traction-roller guide rails from one another, the installation space necessary for the escalator can thus be substantially reduced.

It has, however, been recognized in particular that the procedure of guiding adjacent treads together and that of the engaging opposing intermeshing structures into each other can be critical. Specifically, there may be a risk that the opposing intermeshing structures can be positioned in a manner not complementary to each other, so that ribs of the one intermeshing structure do not fit precisely into the grooves of the other intermeshing structure. This can result in a collision between the adjacent treads in the region of their intermeshing structures, wherein the intermeshing structures can be damaged. In particular, this can result in increased wear on the intermeshing structures. As a worst case, the intermeshing structures can even be bent, whereby significant risks can result for the integrity of the escalator as well as for the passengers using the escalator. Precisely for these reasons, it has been previously assumed that a meshably engaging displacement of the treads in the return run of the escalator is too risky.

It has now been discovered that the indicated risks can be minimized if the chain-roller guide rails and the traction-roller guide rails in a transition region between the upper horizontally running region and the central region running at an incline of the track are designed to run inclined differently relative to one another in a very specific manner. In other words, it is certainly true the chain-roller guide rail and the traction-roller guide rail can be arranged essentially even and parallel to each other in large sections of the upper horizontally running region as well as in the central region of the track running at an incline. However, in a transition region between the two regions, the two guide rails must each be curved, and it was recognized that it may be advantageous to curve the two guide rails in different ways, meaning with different radii of curvature and/or a different curve shape.

In particular, the different curve shapes of the different guide rails should be designed in such a manner that adjacent treads, which are guided along the guide-rail assembly, are guided in such a manner that the front intermeshing structure of one tread is spaced apart from the rear intermeshing structure of the adjacent tread by a gap, as long as both treads are being moved along the upper horizontally running region of the track. However, as soon as the treads follow each other in succession into the transition region and are moved along this transition region into the central region of the track running at an incline, the front intermeshing structure of the tread engages into the rear intermeshing structure of the adjacent tread, wherein the movement of the treads relative to one another is done in such a way that the front intermeshing structure of the one tread is guided into a region of the riser of the adjacent tread in the intermeshing structure provided there and thus a gap between the two intermeshing structures becomes successively smaller until the two intermeshing structures are meshably engaged into one another. The term "horizontal" in this context is to be interpreted broadly and may be interpreted as including directions essentially parallel to that of the guide rail.

In other words, it was recognized that in conventional escalators it was previously assumed that adjacent treads in the return run could be brought into a meshable engagement only in a manner in which the treads were to be moved in a substantially vertical manner. The front intermeshing structure of a tread was brought closer to the adjacent tread from below, whereby there was a significant risk that the intermeshing structures would collide with each other and be damaged. In contrast to this, it is now proposed to guide the treads by a specific form of the chain-roller guide rail and the traction-roller guide rail in the transition region between the horizontal region and the region running at an incline of the track, so that they are not moved vertically towards each other, but have a decreasing gap between the treads in a horizontal direction. The intermeshing structures of the two treads can in this way better engage into one another. Even in the case that the two intermeshing structures are not mounted exactly complementarily to each other, a slight offset between the front intermeshing structure of one tread and the rear intermeshing structure if the adjacent tread can be mostly equalized by slight lateral relative movements between the two treads, if they are moved horizontally towards each other, in particular because the rear intermeshing structure is formed on the most gently curved riser of the tread.

According to one embodiment, the chain roller guide rail and the idler roller guide rail in the transition region are designed to run at a different curvature relative to each other so that a distance between the chain-roller guide rail and the traction-roller guide rail coming from the upper horizontally running region is first increased and then is gradually reduced further toward the central region running at an incline.

In other words, the chain-roller guide rail and the traction-roller guide rail are arranged parallel and with a first distance to each other over an extensive part of the upper horizontally running region of the track. Upon entry into the transition region, this distance preferably increases at first in order to then decrease again in the further run of the transition region towards the region of the track running at an incline and even become smaller than the first distance.

By the variation of the distance between the two guide rails in the course of the transition region, the treads that are guided on the guide rail via their chain rollers and idler rollers are guided in a specific manner and, specifically, tilted relative to each other. Such a tilting of the treads during a simultaneous convergence of adjacent treads can be used to move adjacent treads in a direction towards each other in a desired manner, so that the risk of collisions when the intermeshing structures eventually meshably engage is minimized.

According to one embodiment, the chain-roller guide rail in the transition region has two curved regions of sharp curvature close to its border with an interposed curved region having a gentler curvature.

Expressed differently, the chain-roller guide rail first has a sharp curvature at the border of the transition region where it transitions to the upper horizontally running region, then extends on the way to the central region running at an incline having first a gentler curvature, and then again assumes a sharper curvature at the other border of the transition region before the transition to the central region running at an incline. Because of a design of the chain-roller guide rail that is curved in this manner, chain rollers guided in it can be displaced in such a manner while passing through the transition region that a desired movement of the guided treads ensues, in particular a desired tilting of the tread.

Specifically, according to one embodiment, the chain-roller guide rail in at least one of the curved regions close to the border has a sharper curvature than the traction-roller guide rail in the associated region.

In other words, although the chain-roller guide rails and the traction-roller guide rails run parallel to each other in the upper horizontally running regions as well as in the central region running at an incline, a change of direction within the transition region connecting these two regions is, however, preferably not carried out synchronously. Instead, in at least one of the corresponding curved regions close to the border, the chain-roller guide rail is more curved than the traction-roller guide rail. Preferably, the chain-roller guide rail in the two curved regions close to the border, meaning bordering both the upper horizontally running region as well as the central region running at an incline, is more curved than the traction-roller guide rail. This causes a greater tilting of the guided tread through one or both of these curved regions close to the border, which tilting is more pronounced than in a case in which the two guide rails would be evenly and synchronously curved with each other.

In this context, the "associated region" of the traction-roller guide rail can be understood as that region which lies closest to the relevant region of the chain-roller guide rail, or over which the traction-roller of a tread rolls if the chain-roller of the same tread rolls over the corresponding region of the chain-roller guide rail.

In a similar manner, according to one embodiment, the chain-roller guide rail in the interposed curved region has less curvature than the idler roller guide rail in a corresponding region.

To put it another way, the chain-roller guide rail, when it is preferably about in the middle of the transition region, is preferably less curved than the traction-roller guide rail in the associated region.

According to another embodiment, the chain-roller guide rail can preferably even be level in the interposed curved region, meaning have a curvature of zero.

In other words, the chain-roller guide rail in its border regions can be highly curved, in particular more highly curved than corresponding regions of the traction-roller guide rail, yet run level in the interposed curved region.

In general, the curvatures in the border regions and the interposed region are designed in the same directions, or the interposed region is not curved, meaning level. It is also conceivable that the interposed region is slightly curved in an opposing direction, meaning both border regions are convexly curved and the interposed region is slightly concave, at least in partial regions.

In particular by virtue of the aforementioned possible designs of chain-roller and traction-roller guide rails with respect to their locally varying curvatures, according to one embodiment, the chain-roller guide rails and the traction-roller guide rails in the transition region can be designed with a different curvature relative to each other such that a tread, while passing through the transition region coming from the upper horizontally running region, first has its front intermeshing structure moved away from the rear intermeshing structure of the adjacent tread in a tilting manner and then is moved tilting in the opposite direction towards the rear intermeshing structure of the adjacent tread.

Such an initial tilting away of the tread from its previously adjacent tread and subsequent tilting towards this adjacent tread can perform the movement of the opposed intermeshing structures of the two treads in an appropriate manner that decreases the gap between them, in order to then be able to meshably engage them into one another without damage.

The adjacent ribs and interposed grooves of the front intermeshing structure and the rear intermeshing structure preferably have a conical cross-section for supporting the meshing engagement. In this manner the engagement is additionally facilitated, particularly in step bands having many operating hours and thus greater play in the articulation points of the traction means, because the groove width at the end face is larger and the rib width at the end face is narrower. The result is a movement of the flanks of the ribs of the two adjacent treads that mutually align because of the lateral forces that arise.

The conical cross-section of ribs and grooves have a flank angle between 0.5° and 10°, preferably between 1° and 5°, most preferably of 3°.

It should be noted that some of the possible features and advantages of the disclosure are described here with reference to different embodiments. A person skilled in the art recognizes that the features may be combined, adapted, or exchanged as appropriate in order to yield other embodiments of the present disclosure.

BRIEF DESCRIPTION OF THE DRAWINGS

Embodiments of the present disclosure are described below with reference to the accompanying drawings, wherein neither the drawings nor the description are to be interpreted as limiting the present disclosure.

The drawings are only schematic and are not true to scale. Like reference signs refer in different drawings to like or analogous features.

DETAILED DESCRIPTION

Figure 1:
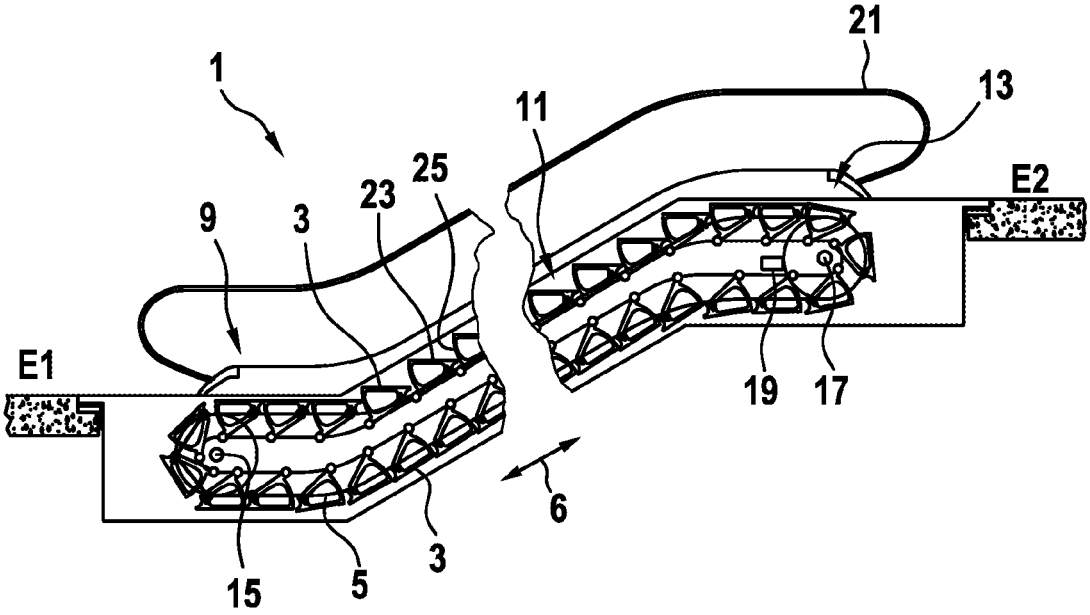
FIG. 1 shows a schematic overview of an escalator.

FIG. 1 shows an exemplary escalator 1 by which people can be conveyed, for example, between two levels E1, E2. Escalator 1 has a plurality of treads 3 that are arranged one after another and that can be displaced in a direction counter to movement 6 along a travel path using two closed-loop conveyor chains 5 that are parallel to one another in the horizontal direction (only one is visible in FIG. 1) Each tread 3 is thus mounted close to its lateral end on one of conveyor chains 5. In order to be able to displace conveyor chains 5, escalator 1 provides a drive assembly 19 (which is only very schematically indicated in FIG. 1) having at least partially driven deflection or chain wheels 15, 17. The chain or deflecting wheels 15, 17 as well as additional supporting components of escalator 1 are held in a supporting structure (partially shown in FIGS. 5 and 6, but not illustrated in FIG. 1 for reasons of clarity), which is mostly designed in the form of a framework structure. Escalator 1 further provides a hand rail 21.

Treads 3 are thus moved during an upward conveying operation in the forward run from a lower horizontally running region 9 bordering lower level E1 through a central region 11 running at an incline to an upper horizontally running region 13 bordering the upper level E2 and then moved back in the opposite direction in the return run.

Figure 2:
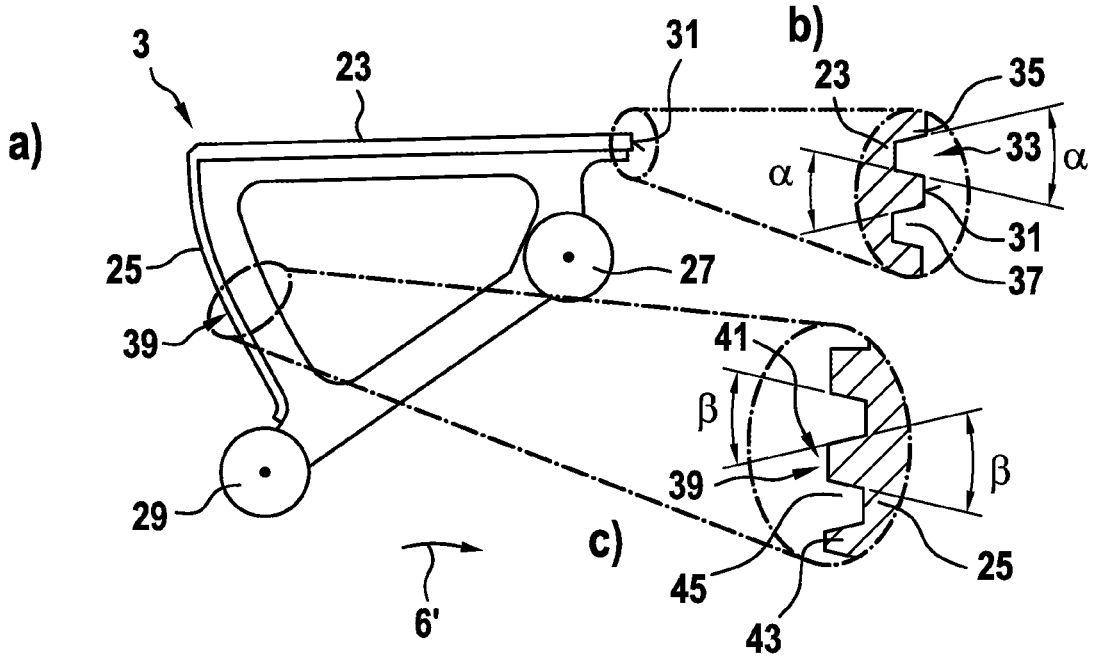
FIGS. 2 (*a*), (*b*) and (*c*) show a side view of a tread and an enlarged view of both a front and a rear intermeshing structure at a tread surface or riser of the tread.

As shown in FIG. 2, each tread 3 has a tread surface 23 that is directed upward during the forward run. Seen in a direction of movement 6', in which tread 3 moves up towards level E2 in the forward run, there is a riser 25 at a rear edge of tread 3 that extends downward transverse to tread surface 23. Tread 3 has a chain roller 27 below its front end and an idler roller 29 below its rear end. Chain roller 27 is thus arranged in a direction orthogonal to tread surface 23 at a smaller distance from tread surface 23 than idler roller 29.

As shown in FIG. 2(*b*) in a top view rotated 90° with respect to FIG. 2(*a*), a front intermeshing structure 33 having ribs 35 and interposed grooves 37 is formed at a frontward facing end face 31 running transverse to tread surface 23. A rear intermeshing structure 41 complementary to this, also having ribs 43 and interposed grooves 45, is formed at a rearward facing region 39 of riser 25, as can be seen in FIG. 2(*c*) in a cutaway view rotated 90° with respect to FIG. 2(*a*).

During a forward run, treads 3 of escalator 1 are typically guided in such a manner that their front and rear intermeshing structures 33, 41 mesh into one another, meaning meshably engage into each other and thus form a minimizing and meandering gap between adjacent treads 3. During a return run, however, treads 3 on conventional escalators 1 are guided at a sufficient distance from each other as to prevent a meshable engagement of adjacent treads 3 previously deemed to be risky at the very least.

Figure 3:
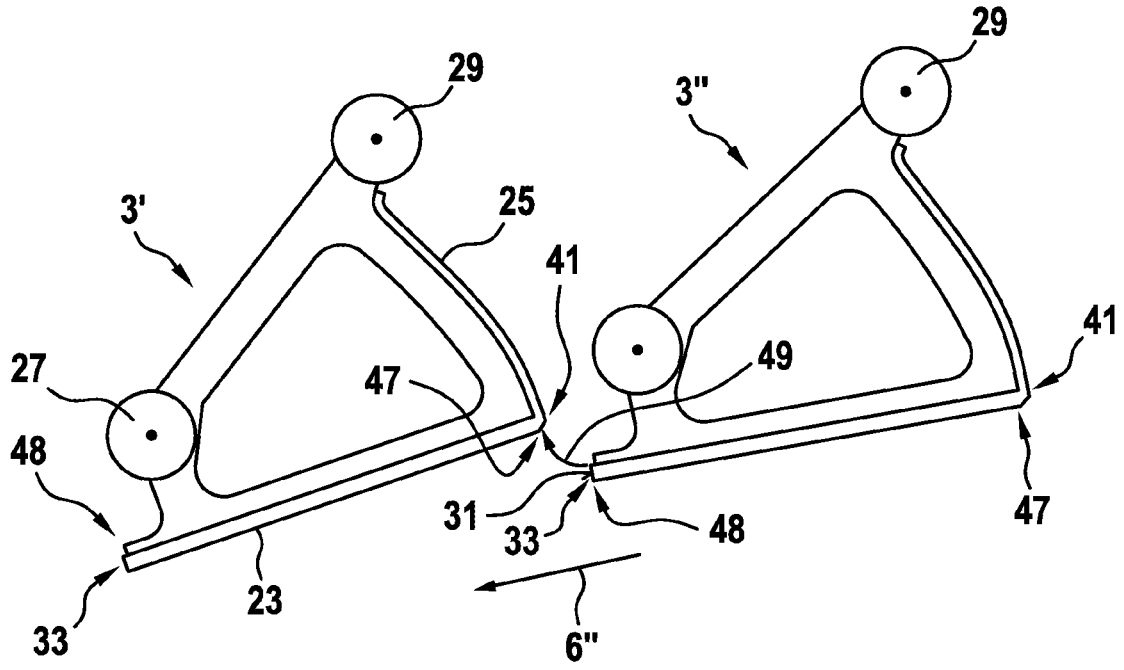
FIG. 3 illustrates a theoretical sequence of movements occurring during a meshing engagement of treads of a conventional escalator.

It was previously assumed here that during a return run, meaning in a direction of motion 6" down to the lower level E1, as is shown schematically in FIG. 3, a leading tread 3' and a trailing tread 3" adjacent to this could only be brought together with their front and rear intermeshing structures 33, 41 in a manner, in which the front end face 31 of the trailing tread 3" approaches a rear edge region 47 of forward-running tread 3' from below. In this arrangement, as a theoretical conventional approaching motion using arrow 49 shows in FIG. 3, a front edge region 48 of trailing tread 3", which borders front end face 31, would be moved, first approximately horizontally and then approximately vertically, relative to tread surface 23 of leading tread 3' in its rear edge region 47.

Particularly if guiding mechanisms in escalator 1 develop play over the course of time and can no longer precisely guide treads 3, it may happen that front intermeshing structures 33 on end face 31 no longer fit exactly complementarily into rear intermeshing structure 41 on rear edge region 47 of leading tread 3'. In this case, collisions between intermeshing structures 33, 41 can occur, which can result in wear and tear or, in the worst case, in damage to intermeshing structures 33, 41. However, damaged intermeshing structures 33, 41 could collide with, for example, comb plates of the escalator and thus provoke further damage and possibly put at risk the operation of the escalator. Damaged intermeshing structures 33, 41 may also constitute a hazard for passengers, for example, a tripping hazard.

For this reason, allowing adjacent treads 3 from meshably engaging into each other during a return run was heretofore avoided. In addition to an increased space requirement for escalator 1, however, this also caused a lack of guidance of adjacent treads 3 in relation to each other. Because individual treads 3 are not guided by engagement in adjacent treads 3, other guidance mechanisms must therefore generally be provided. For example, guiding rollers such as chain rollers 27 or idler rollers 29 are led along guide rails that have elevations or connection pieces along their lateral edges. However, such restraints can lead to undesired friction losses and/or to a significantly increased wear and tear on guided rollers 27, 29.

It has now been recognized, however, that in the case that adjacent treads 3', 3" in an escalator 1 according to the disclosure are guided in a special manner in a modified approaching motion 51 during their convergence toward each other, and in particular are tilted relative to each other, an essentially risk-free meshable engagement of intermeshing structures 33, 41 can also be produced for treads 3 located in the return run.

Figure 4:
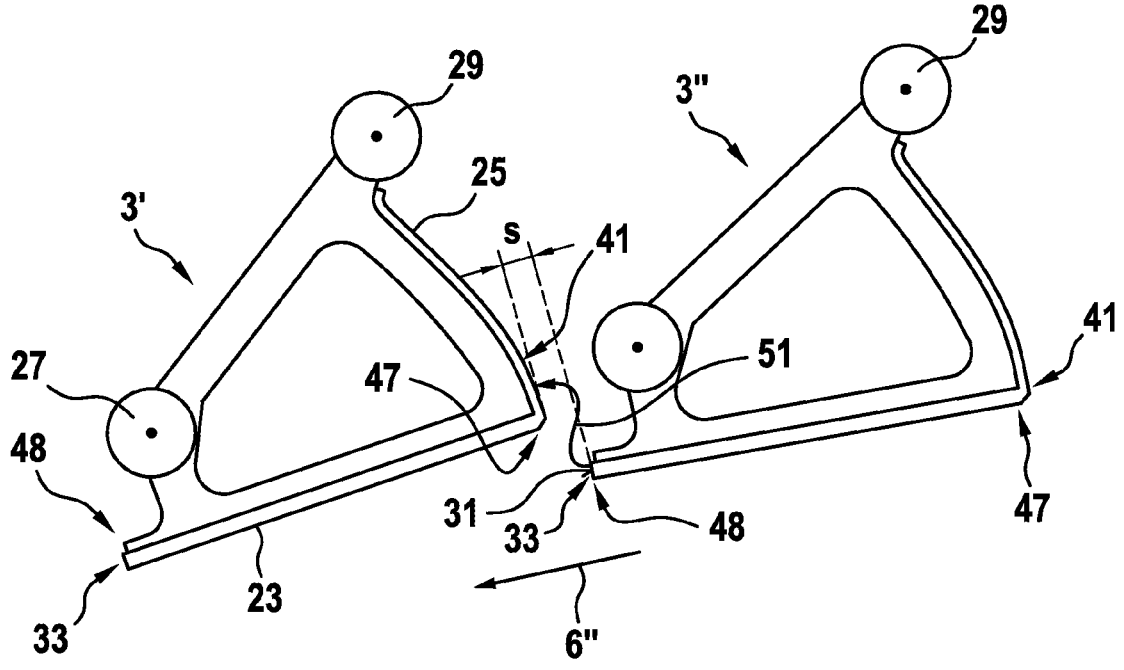
FIG. 4 illustrates an intended sequence of movements as treads of an escalator according to an embodiment are meshably brought together.

A corresponding relative motion of adjacent treads 3', 3" is shown in FIG. 4 using arrow 51. Trailing tread 3" is thus appropriately tilted at first as it approaches leading tread 3', so that its front edge region 48 is displaced vertically and is no longer located below tread surface 23 in leading tread 3', but above rear edge region 47 of tread surface 23 and horizontally behind riser 25 of leading tread 3'. Only after such a tilting are trailing tread 3" and leading tread 3' then brought together in such a manner that a gap s between them in an essentially horizontal direction gradually becomes smaller until front intermeshing structure 33 of trailing tread 3" meshably engages into rear intermeshing structure 41 of leading tread 3'. "Horizontal" in this context is to be interpreted broadly and can be interpreted as including directions essentially parallel to that of guide rails 57, 59 (see FIGS. 5 and 6), for example, having a tolerance of ±30°.

Figure 5:
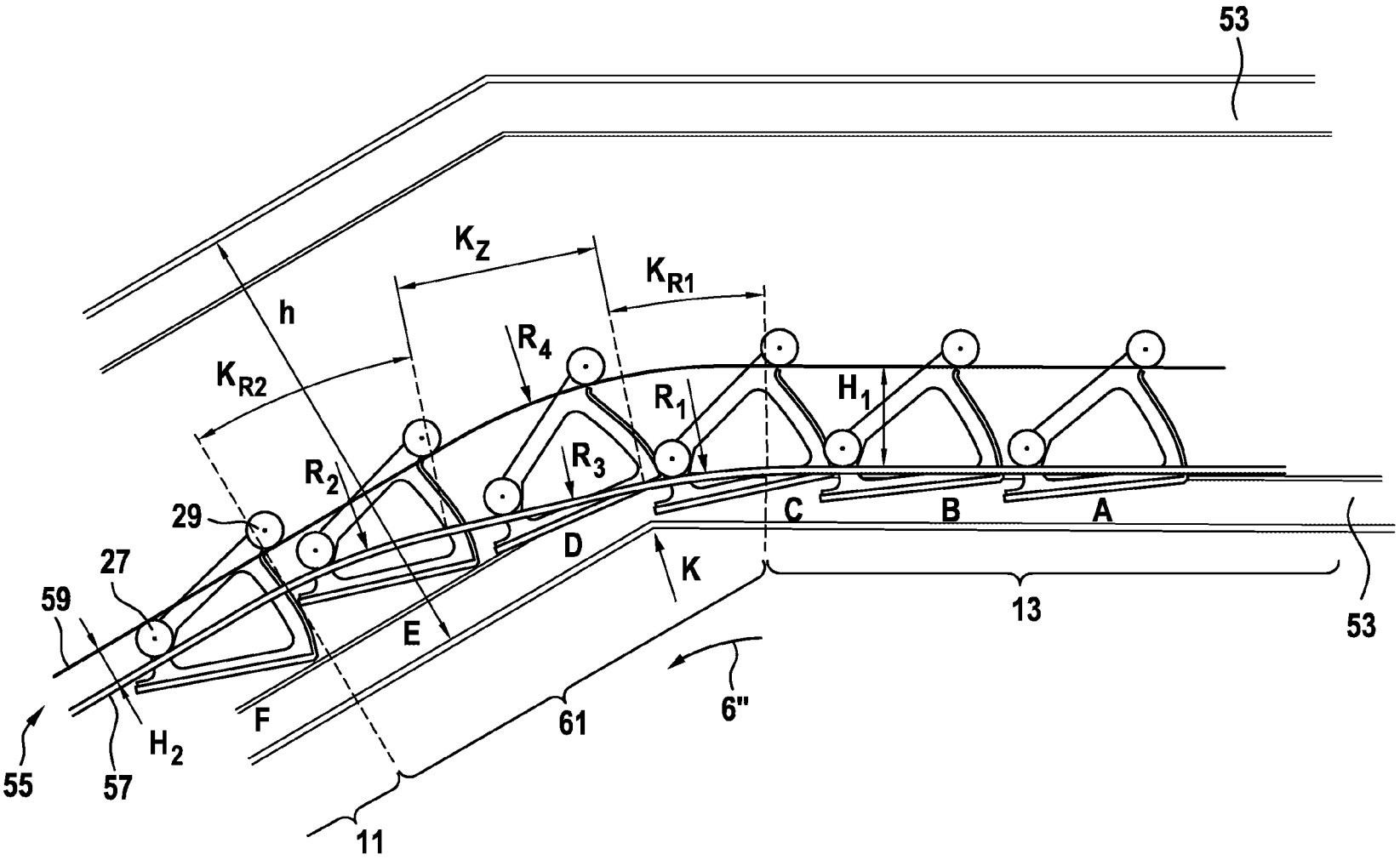
FIG. 5 illustrates a geometrical configuration of the essential components of an escalator according to an embodiment.
Figure 6:
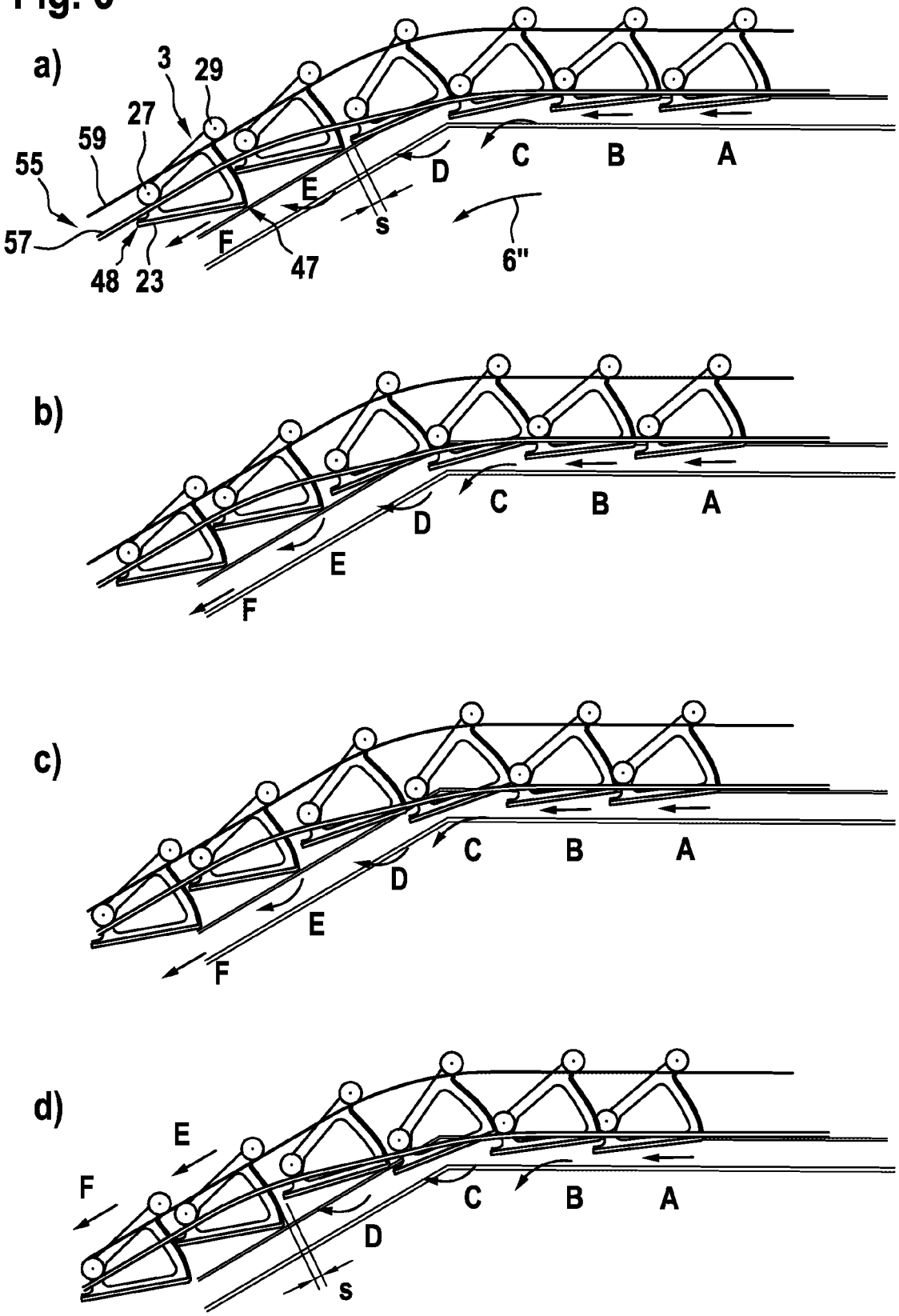
FIGS. 6(*a*) to (*d*) illustrate a chronological sequence of treads moving along a return run of an escalator according to an embodiment.

A corresponding relative motion of adjacent tread 3 of an escalator 1 according to the disclosure is shown in FIG. 5 as well as in FIG. 6(*a*) to (*d*). In order to be able to clearly recognize the motions of treads 3, illustration of additional structures or components of supporting structure 53, such as chain wheel 17 of escalator 1, that are not relevant for understanding these motions has been omitted.

FIG. 5 as well as FIG. 6(*a*) to (*d*) thus represent an upper region of a track of escalator 1 in a chronological sequence, while the treads 3 are guided in direction of motion 6" in the return run from upper horizontally running region 13 into the central region 11 running at an incline. Treads 3 arranged one after another are thus numbered consecutively with letters A to F and, starting from the configuration shown in FIG. 5 or FIG. 6(*a*), move successively farther left in the following FIGS. 6(*b*) to (*d*) in direction of motion 6". FIG. 6(*a*) thus corresponds to FIG. 5, wherein, in the interest of clarity, some of the names registered in FIG. 5 were omitted.

Each of treads 3 is thus guided in its motion along the travel path using a guide-rail assembly 55. Chain rollers 27 attached at the front of a tread 3 thus each run along chain-roller guide rail 57, while idler rollers 29 attached at the rear of tread 3 are each guided along a traction-roller guide rail 59. In each case, one chain-roller guide rail 57 and one traction-roller guide rail 59 are thus arranged laterally bordering the track, meaning adjacent to one of the lateral edges of tread 3.

Chain-roller guide rail 57 and traction-roller guide rail 59 are separated from each other in a vertical direction H, meaning transverse to their longitudinal direction. In extensive parts of upper horizontally running region 13 and central region 11 running at an incline, chain-roller guide rail 57 and traction-roller guide rail 59 run parallel to each other. Distance $H_1$ between the two guide rails 57, 59 in the upper horizontally running region 13 is thus significantly larger than distance H2 in central region 11 running at an incline, for example, more than 50% larger, preferably more than twice as large. In this manner, inter alia, a height h of supporting structure 53 in central region 11 running at an incline can be smaller than in conventional escalator 1 so that escalator 1 requires a smaller installation space within a building because of its generally smaller configuration and can also have a lesser weight.

In a transition region 61 that stretches between upper horizontally running region 13 and central region 11 running at an incline and that connects these regions 13, 11, chain-roller guide rail 57 and traction-roller guide rail 59 have significantly differently curved courses. While traction-roller guide rail 59 is curved with a uniform curvature radius $R_4$, or is at least curved in such a manner that its curvature approximately in the center of transition region 61 assumes a maximum curvature radius $R_4$, chain-roller guide rail 57 has three different partial regions with different curvatures $R_1$, $R_2$ and $R_3$.

A first curved region $K_{R1}$ close to the border, bordering transition region 61 at horizontally running region 13, has here a first curvature $R_1$ that is sharper than curvature $R_4$ in an associated region of traction-roller guide rail 59, meaning it has a smaller curvature radius than this. This first curved region $K_{R1}$ close to the border also preferably spans a sharp bend K, at which the horizontal part of the framework, which forms supporting structure 53, transitions into a part of this framework running at an incline.

An opposing second first curved region $K_{R2}$ close to the border, at which transition region 61 abuts central region 11 running at an incline, has a second curvature $R_2$ that can also be sharper than curvature $R_4$ in an associated region of traction-roller guide rail 59, but which is at least greater than a curvature $R_3$ in interposed region of curvature $K_Z$.

In interposed curved region $K_Z$, the curvature is substantially gentler than in the two adjacent curved regions $K_{R1}$ and $K_{R2}$ close to the border and in particular gentler than curvature $R_4$ of the traction-roller guide rail. Specifically, interposed curved region $K_Z$ can be approximately flat, meaning it has no curvature or has a curvature with an infinite radius of curvature.

In the motion sequence illustrated in FIGS. 6(*a*) to (*d*), treads 3 in a return run move from right to left. For each of treads 3 there is a tilting motion, marked in the different figures by an arrow, with which the indicated tread 3 is tilted in the corresponding stage of the sequence of motion because of the guidance of the guide-rail assembly 55.

It can be recognized that one tread 3, such as the tread with the designation C, coming from an upper horizontally running region 13 and traveling into transition region 61 is first tilted counter-clockwise, because in curved region $K_{R1}$ close to the border the distance between chain-roller guide rail 57 and traction-roller guide rail 59 is initially increased. However, this distance then decreases again in further travel if tread 3 runs through interposed curved region $K_Z$. Tread 3 is then tilted clockwise by this. Simultaneously tread 3 is guided by guide-rail assembly 55 in such a manner that it approaches a leading tread 3. A gap s between front end face 31 of the one tread 3 and riser 25 of adjacent tread 3 becomes successively smaller so that intermeshing structure 33 of front edge face 31 approaches intermeshing structure 41 at riser 25 in a horizontal direction and finally meshably engages into it.

During the passage through transition region 61, adjacent treads 3 are thus guided and tilted in such a manner relative to one another and relative to supporting structure 53 that, on the one hand, they do not collide with supporting structure 53, in particular in the region of its sharp bend K. On the other hand, treads 3 are brought closer to each other in an essentially horizontal direction in such a manner that end face 31 of a trailing tread is brought closer to the adjacent tread, especially to its riser 25, not from below, but from behind.

Through this essentially horizontal convergence of intermeshing structures 33, 41 of adjacent treads 3, it can on one hand be achieved that intermeshing structures 33, 41 are brought together relatively slowly, and sufficient time thus remains that these can align themselves to one another if necessary. On the other hand, by virtue of trailing tread 3 with its front intermeshing structure 33 being moved not from below abutting tread surface 23, but horizontally from behind toward riser 25 abutting adjacent tread 3, even in the case in which intermeshing structures 33, 41 are not initially aligned to fit exactly together, the exertion of excessive force on intermeshing structures 33, 41, rollers 27, 29 and guide-rail assembly 55 and, in the worst case, damage to them can be avoided.

As is illustrated in FIG. 2, for supporting the meshable engagement, adjacent ribs 35, 43 and interposed grooves 37, 45 of front intermeshing structure 33 and rear intermeshing structure 41 preferably have a conical cross-section. In this manner, engagement is made significantly easier because the groove width of grooves 37, 45 at end face 31 and at the rearward-facing region of riser 39 is greater and the rib width of ribs 35, 43 is correspondingly narrower. The result is at most a contact of the lateral flanks of ribs 35, 43 of two adjacent treads 3 that align to each other because of the lateral forces that arise during the meshable engagement.

The conical cross-section of ribs 35, 43 and grooves 37, 45 have a flank angle α, β between 0.5° and 10°, preferably between 1° and 5°, most preferably of 3°. Of course, the two flank angles α, β can be designed different from each other.

Although the disclosure has been described through the illustration of specific exemplary embodiments, it is clear that countless additional embodiment variants can be created within the context of the present disclosure. The sequence of motion shown in FIGS. 5(*a*) to (*d*) is made possible by the shape of chain-roller guide rail 57 designed especially for that purpose and matched to the shape of traction-roller guide rail 59. It is clear from this illustration, however, that instead of chain-roller guide rail 57, traction-roller guide rail 59 can have a design with three different curved regions $K_{R1}$, $K_{R2}$, $K_Z$. Clearly, chain-roller guide rail 57 as well as traction-roller guide rail 59 can each have a design with three different curved regions $K_{R1}$, $K_{R2}$, $K_Z$ to thus achieve the arrangement of intermeshing structures 33, 41 of adjacent treads 3 in a meshably engaged manner via the proposed, special design of guide-rail system 55 at least also in central region 11 of the return run running at an incline.

Finally, it should be noted that terms such as "comprising" and the like do not preclude other elements or steps, and terms such as "a" or "one" do not preclude a plurality. Furthermore, it should be noted that features or steps that have been described with reference to one of the above embodiments may also be used in combination with other features or steps of other embodiments described above. Reference characters in the claims are not to be interpreted as being limiting.

The invention claimed is:

1. An escalator comprising:

a plurality of treads arranged one after another along a track, each tread of the plurality of treads comprising a tread surface and a riser adjacent to a rear end of the tread surface and running transverse to the tread surface;

a guide rail assembly having a chain roller guide rail for guiding chain rollers of the plurality of treads and a idler roller guide rail for guiding idler rollers of the plurality of treads during a forward run of a lower, horizontally running region of the track over a central region of the track that runs at an incline toward an upper, horizontally running region of the track and during a return run moving in the opposite direction;

wherein each tread has a front intermeshing structure and a rear intermeshing structure, wherein the front and the rear intermeshing structures are formed complementarily to each other in such a manner that intermeshing structures of adjacent treads oriented toward one another can meshably engage with each other, wherein there is a transition region between the upper, horizontally running region of the track and the central region of the track that runs at an incline, wherein in the transition region of the return run, at least one of the chain roller guide rail and the idler roller guide rail has two curved regions close to the edges of the upper and the central regions of the track having a sharp curvature and an interposed curved region having a gentler curvature, wherein the chain roller guide rail and the idler roller guide rail in the upper horizontally running region of the track are spaced farther apart from each other than in the middle region of the track running at an incline, and wherein the chain-roller guide rail and the idler roller guide rail in the transition region between the upper horizontally running region of the track and the central region of the track running at an incline are designed to run at different curvatures relative to each other, so that adjacent treads guided along the guide rail assembly are guided in such a manner that the front intermeshing structure of a tread is spaced apart from the rear intermeshing structure of the adjacent tread with a gap as long as both treads are moved along the upper horizontally running region of the track, and the front intermeshing structure of the tread is meshably engaged into the rear intermeshing structure of the adjacent tread in a region of the riser in such a manner as to gradually reduce the gap between them in the horizontal direction if the two treads are moved one after another along the transition region in the central region of the track running at an incline.

2. The escalator according to claim 1, wherein each tread comprises a chain roller orthogonally spaced apart from the tread surface close to its front end at a first distance and has a idler roller close to its rear end orthogonally spaced apart from the tread surface at a second distance that is larger than the first distance.

3. The escalator according to claim 1, wherein the chain roller guide rail and the idler roller guide rail in the transition region are designed to run at a different curvatures relative to each other so that a distance between the chain roller guide rail and the idler roller guide rail coming from the upper horizontally running region is first increased and then is gradually reduced further toward the central region running at an incline.

4. The escalator according to claim 1, wherein the chain roller guide rail in the in curved regions has a sharper curvature close to the edge than the idler roller guide rail in the corresponding regions.

5. The escalator according to claim 1, wherein the chain roller guide rail in the interposed curved region has less curvature than the idler roller guide rail in a corresponding region.

6. The escalator according to claim 1 wherein the chain roller guide rail in the interposed curved region is level.

7. The escalator according to claim 1, wherein the chain roller guide rail and the idler roller guide rail in the transition region are designed to run at different curvatures relative to each other, so that a tread, while traversing the transition region coming from the upper horizontally running region, is first moved away with its front intermeshing structure tilted away from the rear intermeshing structure of the adjacent tread and then tilted toward the rear intermeshing structure of the adjacent tread.

8. The escalator according to claim 1, wherein the front intermeshing structure is formed on a forward directed end face of the tread that runs transverse to the tread surface via adjacent ribs and interposed grooves, and the rear intermeshing structure is formed on a rearward directed region of riser via adjacent ribs and interposed grooves.

9. The escalator according to claim 8, wherein the adjacent ribs and interposed grooves of the front intermeshing structure and of the rear intermeshing structure have a conical cross-section in order to support the meshing engagement.

10. The escalator according to claim 9, wherein the conical cross-sections of ribs and grooves have a flank angle between 0.5° and 10°.

11. The escalator according to claim 9, wherein the conical cross-sections of ribs and grooves have a flank angle between 1° and 5°.

12. The escalator according to claim 9, wherein the conical cross-sections of ribs and grooves have a flank angle of about 3°.

13. The escalator according to claim 2, wherein:

the chain roller guide rail and the idler roller guide rail in the upper horizontally running region of the track are spaced farther apart from each other than in the middle region of the track running at an incline; and the chain-roller guide rail and the idler roller guide rail in the transition region between the upper horizontally running region of the track and the central region of the track running at an incline are designed to run at different curvatures relative to each other, so that adjacent treads guided along the guide rail assembly are guided in such a manner that the front intermeshing structure of a tread is spaced apart from the rear intermeshing structure of the adjacent tread with a gap as long as both treads are moved along the upper horizontally running region of the track, and the front intermeshing structure of the tread is meshably engaged into the rear intermeshing structure of the adjacent tread in a region of the riser in such a manner as to gradually reduce the gap between them in the horizontal direction if the two treads are moved one after another along the transition region in the central region of the track running at an incline.

14. The escalator according to claim 13, wherein the chain roller guide rail and the idler roller guide rail in the transition region are designed to run at a different curvatures relative to each other so that a distance between the chain roller guide rail and the idler roller guide rail coming from the upper horizontally running region is first increased and then is gradually reduced further toward the central region running at an incline.

15. The escalator according to claim 14, wherein the chain roller guide rail in the in curved regions has a sharper curvature close to the edge than the idler roller guide rail in the corresponding regions.

16. The escalator according to claim 15, wherein the chain roller guide rail in the interposed curved region has less curvature than the idler roller guide rail in a corresponding region.

17. The escalator according to claim 16, wherein the chain roller guide rail and the idler roller guide rail in the transition region are designed to run at different curvatures relative to each other, so that a tread, while traversing the transition region coming from the upper horizontally running region, is first moved away with its front intermeshing structure tilted away from the rear intermeshing structure of the adjacent tread and then tilted toward the rear intermeshing structure of the adjacent tread.

18. The escalator according to claim 17, wherein the front intermeshing structure is formed on a forward directed end face of the tread that runs transverse to the tread surface via adjacent ribs and interposed grooves, and the rear intermeshing structure is formed on a rearward directed region of riser via adjacent ribs and interposed grooves.

19. An escalator comprising:

a plurality of treads arranged one after another along a track, each tread of the plurality of treads comprising a tread surface and a riser adjacent to a rear end of the tread surface and running transverse to the tread surface;

a guide rail assembly having a chain roller guide rail for guiding chain rollers of the plurality of treads and a idler roller guide rail for guiding idler rollers of the plurality of treads during a forward run of a lower, horizontally running region of the track over a central region of the track that runs at an incline toward an upper, horizontally running region of the track and during a return run moving in the opposite direction;

wherein each tread has a front intermeshing structure and a rear intermeshing structure, wherein the front and the rear intermeshing structures are formed complementarily to each other in such a manner that intermeshing structures of adjacent treads oriented toward one another can meshably engage with each other, wherein there is a transition region between the upper horizontally running region of the track and the central region of the track that runs at an incline, wherein in the transition region of the return run, at least one of the chain roller guide rail and the idler roller guide rail has two curved regions close to the edges of the upper and the central regions of the track having a sharp curvature and an interposed curved region having a gentler curvature, wherein the chain roller guide rail and the idler roller guide rail in the transition region are designed to run at different curvatures relative to each other, so that a tread, while traversing the transition region coming from the upper horizontally running region, is first moved away with its front intermeshing structure tilted away from the rear intermeshing structure of the adjacent tread and then tilted toward the rear intermeshing structure of the adjacent tread.

20. An escalator comprising:

a plurality of treads arranged one after another along a track, each tread of the plurality of treads comprising a tread surface and a riser adjacent to a rear end of the tread surface and running transverse to the tread surface;

a guide rail assembly having a chain roller guide rail for guiding chain rollers of the plurality of treads and a idler roller guide rail for guiding idler rollers of the plurality of treads during a forward run of a lower, horizontally running region of the track over a central region of the track that runs at an incline toward an upper, horizontally running region of the track and during a return run moving in the opposite direction;

wherein each tread has a front intermeshing structure and a rear intermeshing structure, wherein the front and the rear intermeshing structures are formed complementarily to each other in such a manner that intermeshing structures of adjacent treads oriented toward one another can meshably engage with each other;

wherein there is a transition region between the upper horizontally running region of the track and the central region of the track that runs at an incline, wherein in the transition region of the return run, at least one of the chain roller guide rail and the idler roller guide rail has two curved regions close to the edges of the upper and the central regions of the track having a sharp curvature and an interposed curved region having a gentler curvature;

wherein the front intermeshing structure is formed on a forward directed end face of the tread that runs transverse to the tread surface via adjacent ribs and interposed grooves, and the rear intermeshing structure is formed on a rearward directed region of riser via adjacent ribs and interposed grooves; and wherein the adjacent ribs and interposed grooves of the front intermeshing structure and of the rear intermeshing structure have a conical cross-section in order to support the meshing engagement, wherein the conical cross-sections of ribs and grooves have a flank angle between 0.5° and 10°.

* * * * *